United States Patent [19]

Ueda

[11] 4,193,216

[45] Mar. 18, 1980

[54] SPIKE ASSEMBLY FOR SPORTS SHOES

[76] Inventor: Takeshi Ueda, 13-11, Kuruwa-cho, Gunma-ken, Isezaki-shi, Japan

[21] Appl. No.: 950,296

[22] Filed: Oct. 11, 1978

[51] Int. Cl.[2] ..... A43C 15/00

[52] U.S. Cl. ..... 36/67 D

[58] Field of Search ..... 36/67 R, 67 D, 62

[56] References Cited

U.S. PATENT DOCUMENTS

| | | | |
|---|---|---|---|
| 2,578,591 | 12/1951 | Phillips | 36/67 D |
| 3,977,097 | 8/1976 | Veda | 36/67 D |

FOREIGN PATENT DOCUMENTS

| | | | |
|---|---|---|---|
| 732328 | 6/1955 | United Kingdom | 36/67 D |

*Primary Examiner*—Patrick D. Lawson

*Attorney, Agent, or Firm*—Haseltine, Lake & Waters

[57] ABSTRACT

A spike assembly for a sports shoe comprising a spike body formed into a screw element at one end and a spike element at the other end. The middle portion is formed into a flange with a serrated surface facing the screw element. A washer having a serrated surface is mounted on the screw element so that the serrated surfaces of the washer and the flange may engage each other to prevent turning. An annular member made of synthetic resin is also mounted on the screw element to support the washer which is provided with peripheral projections adapted to be engaged with the sole of the shoe.

2 Claims, 6 Drawing Figures

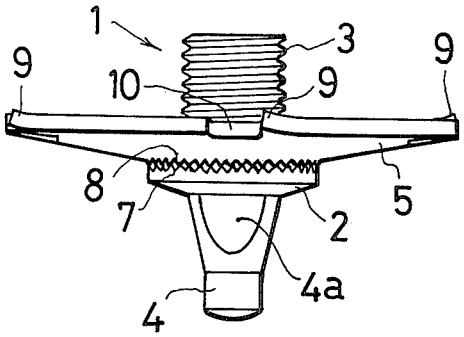
FIG.1
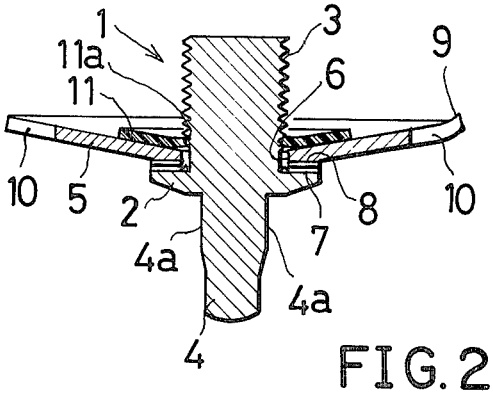
FIG.2
FIG.3
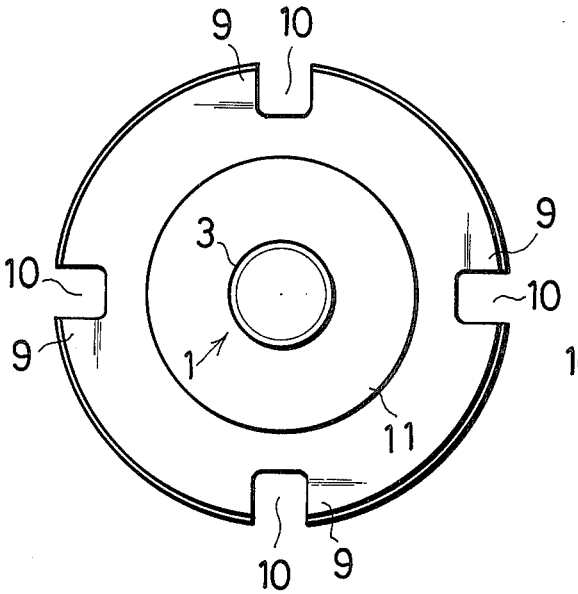
FIG.4
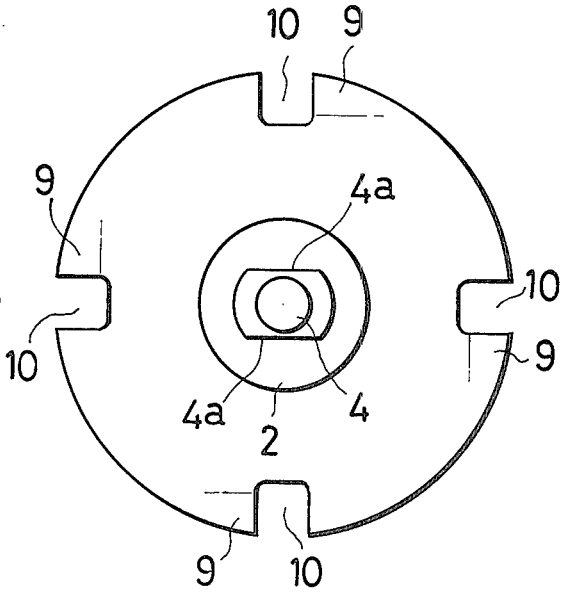
FIG.5
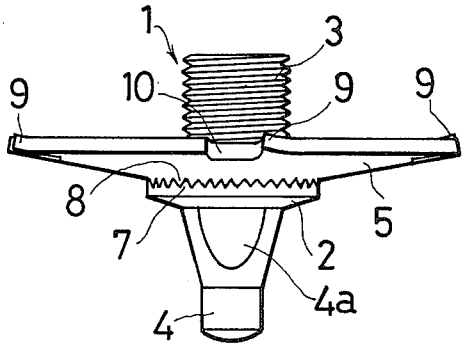
FIG.6
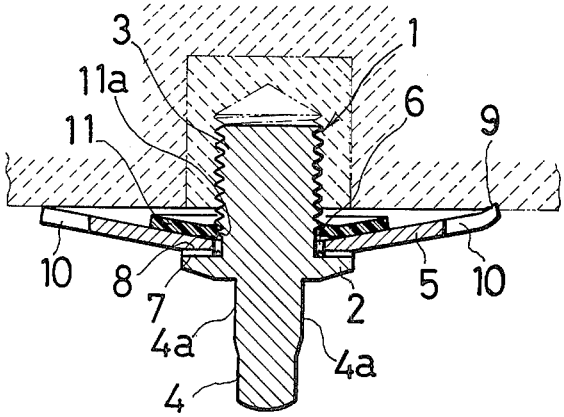

SPIKE ASSEMBLY FOR SPORTS SHOES

SUMMARY OF THE INVENTION

This invention relates to a spike assembly for attachment to the sole of a shoe for sports such as golf or the like.

A known spike assembly for sport shoes includes a washer adapted to be applied to the sole of a shoe and a spike body adapted to be screwed into the shoe sole through a center opening of the washer. These are prepared separately and, at the time of application thereof, the two members are assembled together as one set and are combined together by being attached to the shoe sole. Such separate type is advantageous in that the spike body is easy to manufacture and can be firmly combined with the washer on the shoe sole. But it has the unavoidable disadvantage that, in general a group of the spike bodies and a group of the washers are separately stored and, on application thereof to the shoe sole, one is taken out from each group thereof and these are assembled together into one set.

This invention has as its object to provide a spike assembly wherein the spike body and the washer are assembled together into one set ready for application so as not to be separable from each other, and so that the storage thereof before application and the application thereof to the shoe sole can be facilitated. It is characterized in that there is prepared a spike body having at its middle portion a flange and formed at its one end portion into a screw element and at its other end portion into a spike element; a washer is loosely mounted at its center opening, which is somewhat larger in diameter than the screw element, on the screw element, so that the flange and the washer face one another at their respective serrated surfaces which are engageable one with the other to prevent turning; an annular member made of synthetic resin is mounted at its opening which is somewhat smaller in diameter than the screw element, on the screw element so as to support the washer from the outside thereof; and the washer is provided at its peripheral edge with turning proof projections which are adapted to be engaged with the sole of a shoe.

BRIEF DESCRIPTION OF THE DRAWING

FIG. 1 is a side view of one embodiment of the spike assembly of this invention.

FIG. 2 is a sectional side view thereof.

FIG. 3 is a top plan view thereof.

FIG. 4 is a rear plan view thereof.

FIG. 5 is a side view of the spike assembly in use. and

FIG. 6 is a sectional side view of the spike assembly in use.

DETAILED DESCRIPTION

One embodiment of this invention will now be explained with reference to the accompanying drawings:

Referring to the drawings, numeral 1 denotes a spike body having at its middle portion a flange 2 and formed at its end portion into a screw element 3 and at its other end portion into a spike element 4. A circular washer 5 is loosely mounted at its center opening 6, which is somewhat larger in diameter than the screw element 3, on the screw element 3 so that the washer 5 rests upon the flange 2.

The mutually facing surfaces of the flange 2 and the washer 5 are provided with respective serrated surfaces 7, 8 so as to be engageable one with the other to prevent turning. An annular member 11 made of synthetic resin is forceably mounted at its center opening 11*a*, which is slightly smaller in diameter than the screw element 3, on the screw element 3, whereby the member 11 is in abutment with the outer surface of the washer 5, while the member 11 is kept in engagement at its opening 11*a* with the screw element 3, the same supports the washer 5 from the outer surface of the washer 5, and consequently the washer 5 is assembled with the spike body 1 so as not to come off the latter.

If the spike body 1 of the assembly is turned by utilizing chamfered surfaces 4*a*, 4*a* formed on opposite side surfaces of the spike element 4 and thereby the screw element 3 is screwed into the shoe sole, the washer 5 is pushed by the flange 2 and the serrated surfaces 7, 8 are brought into engagement one with another, and thereafter the washer 5 is turned with the same and is pushed against the shoe sole for attachment thereto.

The washer 5 is provided at its peripheral edge with cut portions 10, and one side corner edge of each cut is slightly bent inwards to form a projection of claw form 9, and thus the spike body 1 is prevented from being unscrewed owing to the fact that the projection 9 eat into the shoe sole thus preventing the washer 5 from unscrewing or loosening. In addition, due to the fact that the washer 5 and the flange 2 are in engagement one with another through the serrated surfaces 7, 8, the spike body 1 can be prevented from unscrewing.

According to this invention, the spike body 1 and the washer 5 are assembled together previously into a spike assembly so as not to be separable one from another in such a manner that the washer 5 is loosely mounted at its center opening 6 on the screw element 3 of the spike body 1 and the annular member 11 is mounted on the screw element 3 to support the washer 5 from the outside thereof, so that storage and application of the spike assembly can be facilitated as compared with the conventional separate type in which the spike body and the washer are selected as one set and assembled together at the time of application thereof. Additionally, according to this invention the annular member 11 is made of synthetic resin and has a center opening 11*a* which is smaller in diameter than the screw element 3, so that the spike assembly can be prepared easily and simply only by putting a light force on the screw member 3. Further, the spike body 1 is prevented from being unscrewed by the turning proof means of the projections 9 peripherally arranged on the washer 5 and of the engagements between the serrated surfaces 7, 8 of the washer 5 and the flange 2, and thereby it is assured that the spike assembly remains stable for a long period.

I claim:

1. A spike assembly for a sports shoe comprising a spike body formed at its one end portion into a screw element and at its other end portion into a spike element and having at its middle portion a flange provided with a serrated surface facing said screw element; a washer provided with a serrated surface and loosely mounted at its center opening, which is somewhat larger in diameter than the screw element, on the screw element, so that the flange and the washer face one another at their respective serrated surfaces, said surfaces being engageable one with another to prevent turning; and an annular member made of synthetic resin mounted at its opening, which is somewhat smaller in diameter than the screw element, on the screw element so as to support the washer from the outside thereof; said washer being provided at its peripheral edge with turning proof projections adapted to be engaged with the sole of the shoe.

2. The spike assembly of claim 1 wherein said spike element is provided on its side portions with opposing chamfered surfaces to facilitate turning of the spike body.

* * * * *